US011396155B2

(12) United States Patent
Block et al.

(10) Patent No.: US 11,396,155 B2
(45) Date of Patent: Jul. 26, 2022

(54) 3D PRINTED PAPERBOARD CREASING/CUTTING RULE

(71) Applicant: The C.W. Zumbiel Company, Hebron, KY (US)

(72) Inventors: Steven J. Block, Amelia, OH (US); Edward A. Zumbiel, Union, KY (US)

(73) Assignee: The C.W. Zumbiel Company, Hebron, KY (US)

( * ) Notice: Subject to any disclaimer, the term of this patent is extended or adjusted under 35 U.S.C. 154(b) by 409 days.

(21) Appl. No.: 15/828,597

(22) Filed: Dec. 1, 2017

(65) Prior Publication Data

US 2018/0154602 A1 Jun. 7, 2018

Related U.S. Application Data

(60) Provisional application No. 62/428,590, filed on Dec. 1, 2016.

(51) Int. Cl.

| | |
|---|---|
| ***B31B 50/14*** | (2017.01) |
| ***B26D 7/08*** | (2006.01) |
| ***B26F 1/44*** | (2006.01) |
| ***B31B 50/00*** | (2017.01) |
| ***B31B 50/25*** | (2017.01) |
| ***B31B 50/81*** | (2017.01) |
| ***B31F 1/22*** | (2006.01) |

(52) U.S. Cl.

CPC ..... *B31B 50/142* (2017.08); *B26D 7/08* (2013.01); *B26F 1/44* (2013.01); *B31B 50/006* (2017.08); *B31B 50/252* (2017.08); *B31B 50/8126* (2017.08); *B31F 1/22* (2013.01); *B26F 2001/4445* (2013.01)

(58) Field of Classification Search

None

See application file for complete search history.

(56) References Cited

U.S. PATENT DOCUMENTS 3,653,304 A 4/1972 Lenoir
3,981,213 A 9/1976 Lopman
(Continued)

FOREIGN PATENT DOCUMENTS

EP 2886320 A1 * 6/2015 ..... B31F 1/08
EP 2886320 A1 6/2015
(Continued)

OTHER PUBLICATIONS

Seaga Group, Creasing Rule, web site print out, 1 pg., Feb. 24, 2017.

(Continued)

*Primary Examiner* — Hemant Desai
*Assistant Examiner* — Tanzim Imam
(74) *Attorney, Agent, or Firm* — Wood Herron & Evans LLP

(57) ABSTRACT

A cutting and/or creasing rule is produced on a 3D printing machine which may be mounted on a board for use is a die for cutting and/or creasing a sheet of paperboard or other material into a blank for a carton. With the advent of additive manufacturing, i.e. 3D printing, it is now possible to eliminate traditional slotted die boards with generally rectangular steel cutting and creasing rules and replace same with surface printed boards with three-dimensional creasing and cutting rules.

25 Claims, 9 Drawing Sheets

(56) References Cited

U.S. PATENT DOCUMENTS

| | | | | |
|---|---|---|---|---|
| D245,831 | S | 9/1977 | West et al. | |
| 4,289,492 | A * | 9/1981 | Simpson | B31F 1/10 493/371 |
| D276,528 | S | 11/1984 | Shaffer | |
| D277,864 | S | 3/1985 | Hoffman, Jr. et al. | |
| 4,963,126 | A | 10/1990 | Jesch | |
| D343,398 | S | 1/1994 | Dunn | |
| 6,203,482 | B1 | 3/2001 | Sandford | |
| 6,441,338 | B1 * | 8/2002 | Rabinovich | B21D 37/205 219/121.64 |
| D616,317 | S | 5/2010 | Yeh | |
| 2005/0209075 | A1 | 9/2005 | Kocherga et al. | |
| 2008/0108490 | A1 | 5/2008 | Kocherga et al. | |
| 2010/0257987 | A1 | 10/2010 | Palm et al. | |
| 2013/0029823 | A1 | 1/2013 | Zoeckler | |
| 2014/0352509 | A1 | 12/2014 | Schroder | |

FOREIGN PATENT DOCUMENTS

| | | | | |
|---|---|---|---|---|
| GB | 2530723 | A * | 4/2016 | B31F 1/10 |
| GB | 2530723 | A | 4/2016 | |
| JP | H09300299 | A | 11/1997 | |

OTHER PUBLICATIONS

Advanced Die Supplies, Creasing Rule, web site printout, 3 pgs., Feb. 24, 2017.
HD Stahl-Steel-Acier, HD Creasing Rules, web site printout, 3 pgs., Feb. 24, 2017.
Ameri-Ken, Steel Rule—Creasing, web site printout, 3 pgs., Feb. 24, 2017.
Cito Group, Hinge Crease, web site printout, 5 pgs., Feb. 24, 2017.
Rotalaser; Consumable Materials, web site printout, 3 pgs., Feb. 24, 2017.
Up Group, Creasing Rule, web site printout, 1 pg., Feb. 24, 2017.
Fag Graphic Systems, Creasing, Scoring, Folding, Embossing, Manual, 53 pgs., Undated.
Iggesund Paperboard, Die-cutting and creasing, Manual, 24 pgs., Feb. 24, 2017.
International Preliminary Examining Authority, International Preliminary Report on the Patentability; PCT/US2017/064171, dated Feb. 7, 2019, 5 pgs.
International Searching Authority, PCT/US2017/064171; Search Report and Written Opinion, 12 pgs, dated Dec. 1, 2017.
www.creativemechanisms.com; Additive Manufacturing vs Subtractive Manufacturing; Jan. 4, 2016, 7 pgs.
European Patent Office, Rule 62 EPC Communication issued in EP 17877202.6-1016 / 3548233 dated Jun. 18, 2020 (7 pages).

* cited by examiner

3D PRINTED PAPERBOARD CREASING/CUTTING RULE

This claims the benefit of U.S. Provisional Patent Application Ser. No. 62/428,590, filed Dec. 1, 2016 and hereby incorporated by reference in its entirety.

BACKGROUND OF THE INVENTION

This invention relates to the conversion of paperboard and other materials to carton blanks, and more particularly, to 3D printed scoring or cutting rules used in the conversion process.

In the conversion of paperboard, the die-cutting and creasing operations are often performed in a flat-bed die-cutting station, which can be off-line or in-line with a printing press. Die-cutting and creasing are frequently combined with embossing operations. Cutting and creasing operations of this type are generally performed on a flat bed cutter, but this invention is equally applicable to rotary die cutting as well as cutting/creasing of corrugated paperboard.

To achieve a consistent, accurate result, it is important to choose the right tools, machine settings, types of paperboard and conditions for the paperboard. Detailed technical information on tool design, machinery and settings is available through established suppliers of machines and tools. Less information, however, is available regarding the interactions between the machinery, tools and paperboard.

Various types of paperboards include mainly Solid Bleached Board (SBB), Folding Box Board (FBB) and White Lined Chipboard (WLC). Types of paperboard include Solid Bleached Sulfate (SBS), Coated Unbleached Kraft (CUK), Coated Recycled Board (CRB), and Folding Box Board (FBB). Corrugated paperboards include mainly virgin or recycled liner board and corrugating medium between the two pieces of liner. All grades can be cut and creased, but to achieve the best result for each application it is important to fine-tune the treatment to give the desired result. This is typically accomplished in a highly labor intensive manner. Due to the type and individual properties of the different paperboard grades, die-cutting, creasing and embossing can be performed to different levels of achievement.

Runnability through the die-cutting and creasing station is important. The paperboard web or sheet 1 (FIG. 1) should be efficiently cut and creased, partly separated and rapidly pushed (or pulled) away. To run satisfactorily, the die-cutting or creasing rules 3 (FIG. 3), and set-up of the machine are critical. The partly cut sheet must have enough integrity to be transported to the stripping unit. Even minor variations and disturbances can cause a breakage and jam the whole production line. A good cut should be clean and free from loose fibers and particles. This will give accurate and clean edges and avoid contamination problems during further processing of the paperboard 1 or in the packaging operation.

Die-cut blanks 5 remain linked to one another by nicks 7 (FIGS. 1-2). To prevent unwanted separation of the blank 5 from the remainder of the sheet during the transfer to subsequent stations, the strength of specific nicks 7 is of great importance for a high production rate. At the same time, it is important that the paperboard blanks 5 can be easily separated in the stripping operation, which removes the paperboard waste 9. One of the most important factors in a clean cut and precisely scored paperboard blank 5 is the scoring or cutting rule 3. The success of such operations depends primarily upon the die-cutting and creasing tools and their set up in the machine. To date, this has been a highly labor intensive task.

A typical die 11 consists of the cutting and creasing rules 3 mounted on a board 13, commonly of Russian birch or the like (FIG. 3). When performing the die-cutting operation, the die 11 reciprocates up and down towards the paperboard 1, which is placed on a make-ready base 15 opposite from the cutting and creasing rules 3 mounted on the board 13 (FIG. 4). After one cycle, the cut and creased paperboard sheet is removed and a new one is fed into the machine.

The most common tool used for die cutting is a steel blade rule 3 (FIG. 3). Based on the desired die cut layout, a craftsman will carve that pattern in the wood board 13. He will then manually bend and shape steel blades and set them into the carved wood board 13. The die will be used in an industrial press to individually cut each sheet of paperboard 1. This is a highly labor intensive task and, as a result, adds significantly to the cost and time required for preparation. Each different paperboard blank 5 requires a different board 13 and associated steel rules 3 as well as a complimentary make-ready base 15.

Once inserted into the board 13, the steel rules 3 are bordered by synthetic foam 17 that protects them and helps push cut components outside the tool when removing it (FIGS. 4-7). The task of the ejection foam rubber 17 is to hold the paperboard 1 in a fixed position during cutting and to eject the paperboard blanks 5 from the cutting die.

The foam rubber 17 of the cutting die 11 plays a very important role for the quality of the final result. Correctly done, the foam rubber 17 also supports productivity by allowing higher speeds and minimizing the risk of stops due to waste 9 coming loose in the machine or sheets 1 not ejecting properly from the die 11. In the cutting operation, the rubber 17 fixes and secures the sheet 1 before and during the cutting and helps to strip the cut material from the sheet.

To achieve clean, debris-free edges it is important to have the correct cutting conditions. Due to its strength, toughness, and density, paperboard requires sharp, well-adjusted knives or rules and good control of the die-cutting machine. The high force required to cut through the paperboard should be well controlled to minimize what is called the "overshoot" of the moving die. Otherwise the rules will hit the make-ready counter plate too hard which will quickly damage the rules and degrade the quality of the cut edges.

When cutting paperboard sheets into carton blanks 5 it is important to achieve the desired shape to feed the blanks 5 properly. All cutting rules 3 must be of the same height to cut through the entire thickness of the paperboard across the die. Fine-tuning the level of each cutting rule is important, time consuming and complicated. Patching up, as it is called, in one area of the sheet might induce disturbances in other areas.

In addition to cutting the paperboard 1 to form the blank 5, the dies typically include creasing rules 3 to crease the paperboard at specific locations to facilitate folding the blank (FIG. 8). Traditionally, the cutting and creasing rules 3 are thin strips of steel having a generally rectangular cross-section to slide into a slot in the die board 13 and rest upon a solid steel base in a typical reciprocating die-cutting machine.

To achieve a well-formed crease, the relationship between its width and depth is of great importance and often determined by the creasing rule 3 and its placement on the board 13. Creasing is carried out using a rule typically in the form of a thin strip of steel with a round smooth edge and an accurately cut groove in a thin hard material on the make-ready 15 (matrix or counter-die). The creasing rule 3 pushes the paperboard 1 into the groove 19 of the make-ready base 15, located under the paperboard, creating a permanent crease. The creasing tool's construction and performance are essential elements in obtaining a satisfactory result.

The creasing rules are fitted into the board 13. When performing the creasing operation, the die 11 reciprocates up and down towards the paperboard 1, which is placed on the make-ready base 15. After one cycle the cut and/or creased paperboard sheet is removed and a new one is fed into the machine. The thickness of the creasing rule, the groove width, the make-ready thickness, and the paperboard thickness must correspond to each other. Different types of paperboard require different tool geometries.

The paperboard is creased by being pressed into the channel or groove 1 in the make-ready base 15. The forces created deform the paperboard 1 in a predetermined way and the deformation is permanent. The result is a reduction in the bending resistance at the crease 21 (FIG. 4). The paperboard 1 is therefore weaker along the crease than elsewhere. During the creasing operation, the paperboard sheet 1 is bent in four narrow zones and in each of these the paperboard must endure high tensile forces or compression forces. Just like the cutting rules, the creasing rules 3 require a significant amount of skill, patience and time for proper installation on the board.

Creasing is an operation which facilitates the folding operation. During creasing the paperboard is weakened along well defined folding lines, which then act as hinges for folding packaging and carton products. It is very difficult to fold paperboard with a good result without creasing. The surface plies will crack and/or the folding line will be undefined.

The labor intensive and time consuming process of preparing the die cutting and creasing board has proven to be a significant factor in limiting the production rates and adding to the cost of mass producing paperboard carton and other blanks. These and other shortcomings in the prior art have been addressed by various embodiments of this invention as described below.

SUMMARY OF THE INVENTION

According to various embodiments of this invention, a cutting and/or creasing rule is produced on a 3D printing machine which may be mounted on a board for use as a die for cutting and/or creasing a sheet of paperboard or other material into a blank for a carton. With the advent of additive manufacturing, i.e. 3D printing, it is now possible to eliminate traditional slotted die boards (with generally rectangular steel cutting and creasing rules) and replace same with surface printed boards with three-dimensional creasing and cutting rules.

One aspect of this invention is to "print" or manufacture the creasing and cutting rules with various printable materials, e.g. HDPE, polycarbonates, etc. Another aspect of this invention is to achieve the strength characteristics or better of traditional steel creasing/cutting rules by utilizing a 3D printed member instead of a traditional steel member. Since steel is much stronger than plastic, a dimensionally identical plastic structure will be weaker than the corresponding steel structure. To enhance the strength of three dimensionally printed rules in relation to traditional steel structures, the geometries of the 3D printed creasing and cutting rule is designed according to this invention both to withstand the downward and lateral forces exerted upon them by the die apparatus and to physically attach to the underlying dieboard.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
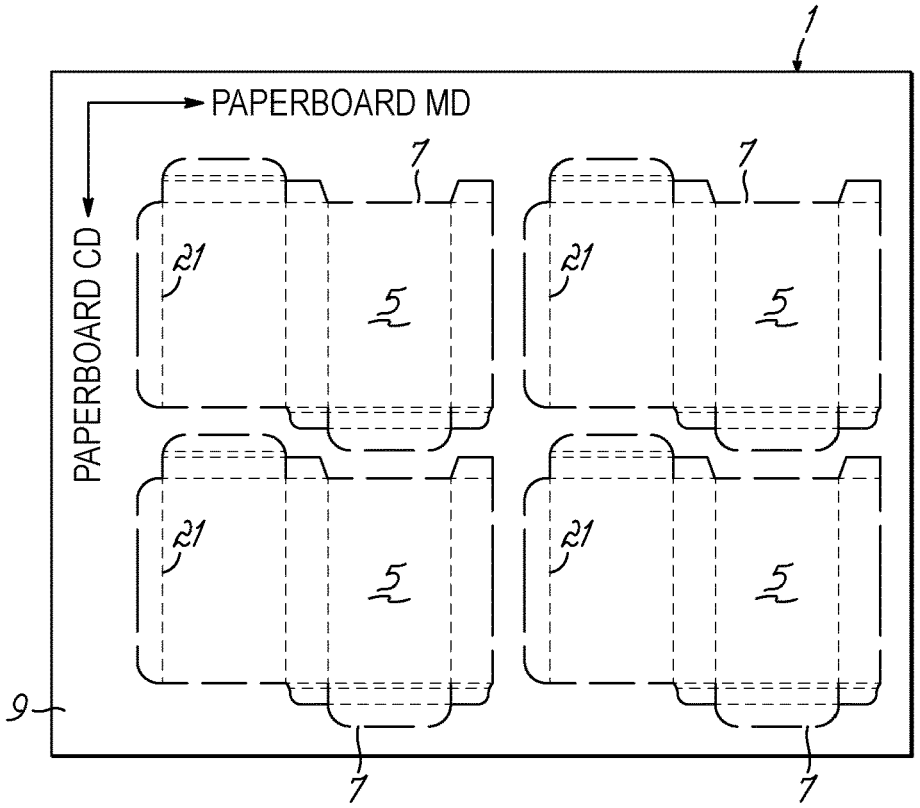
FIG. 1 is a top plan view of a sheet with multiple carton blanks therein.
Figure 2:
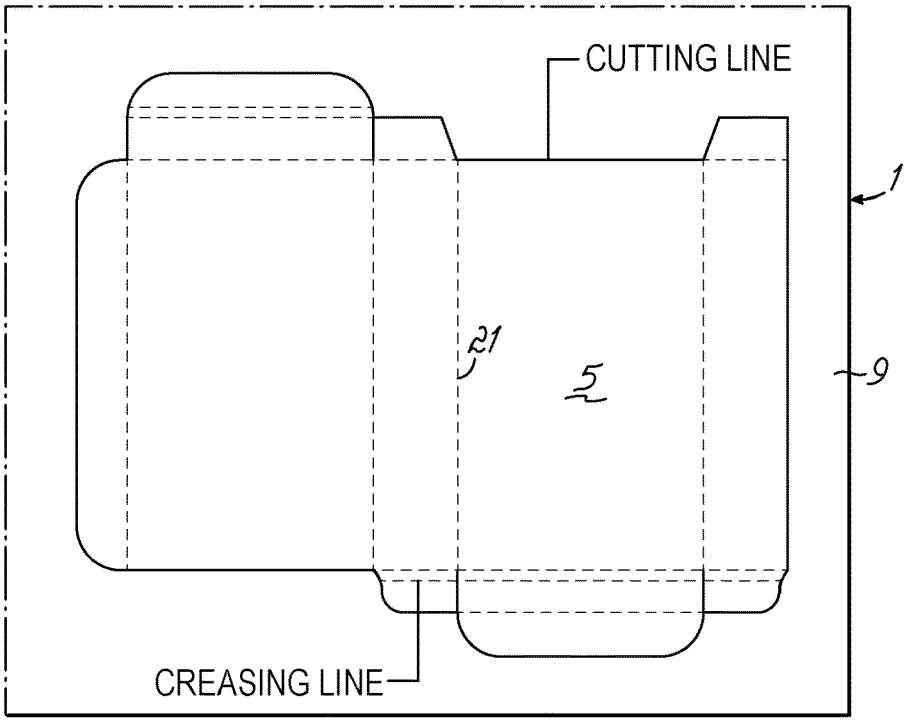
FIG. 2 is a view similar to FIG. 1 of one carton blank.
Figure 3:
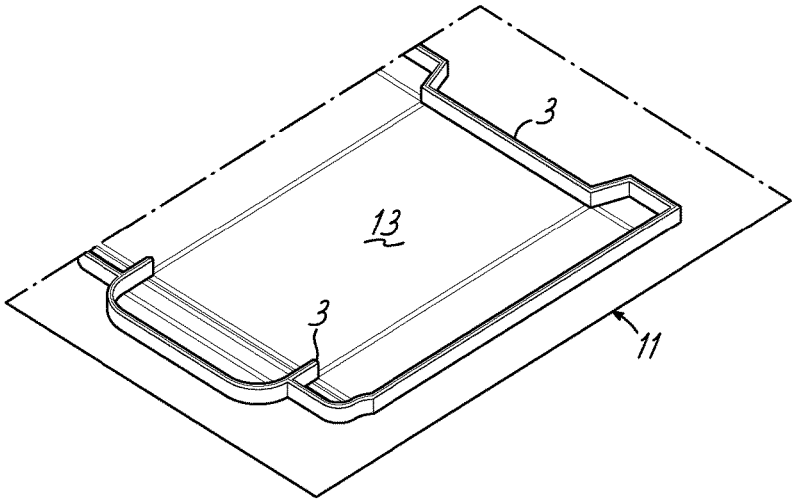
FIG. 3 PRIOR ART
FIG. 3 is a perspective view of a prior art cutting board with a steel blade cutting rule.
Figure 4:
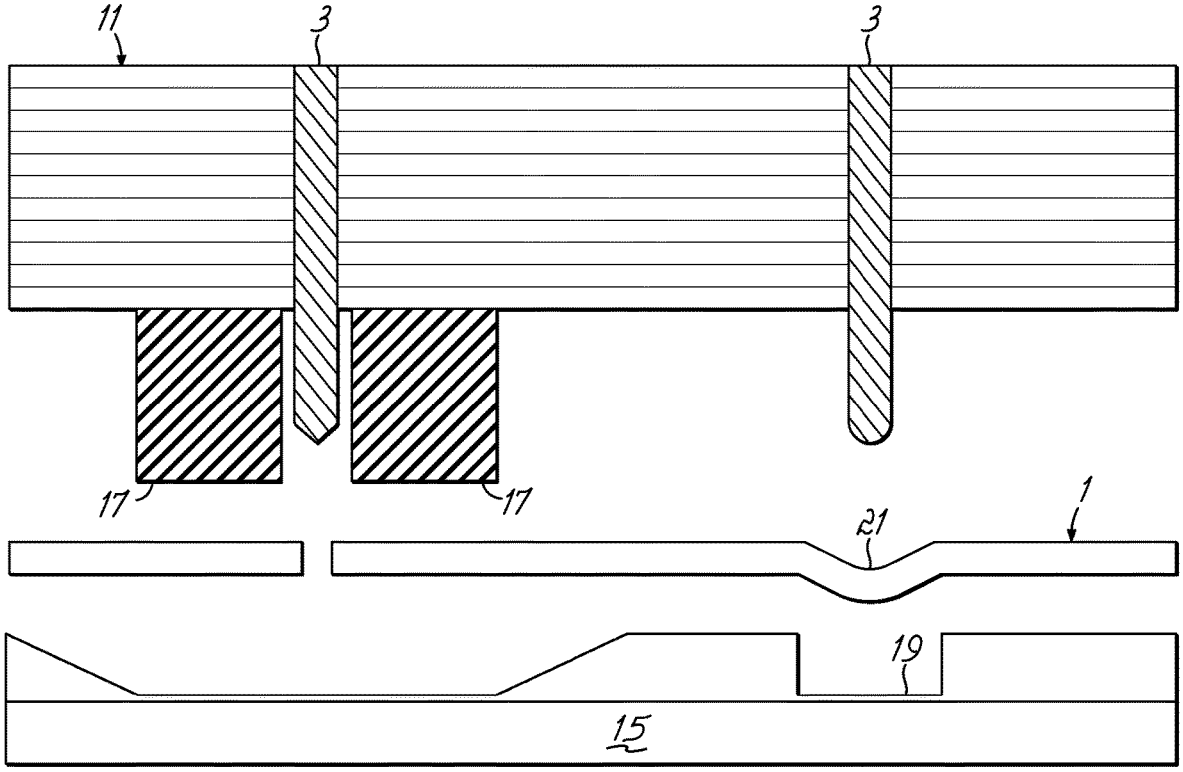
FIG. 4 PRIOR ART
FIG. 4 is a cross-sectional view of the arrangement in FIG. 3 with a sheet of paperboard being cut and creased.
Figure 5:
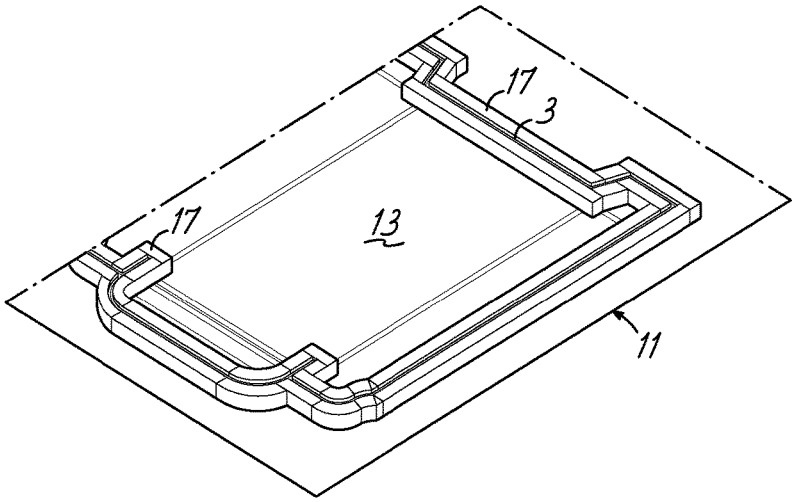
FIG. 5 PRIOR ART
FIG. 5 is a perspective view of a prior art cutting board with ejection foam rubber proximate a steel blade cutting rule.
Figure 6:
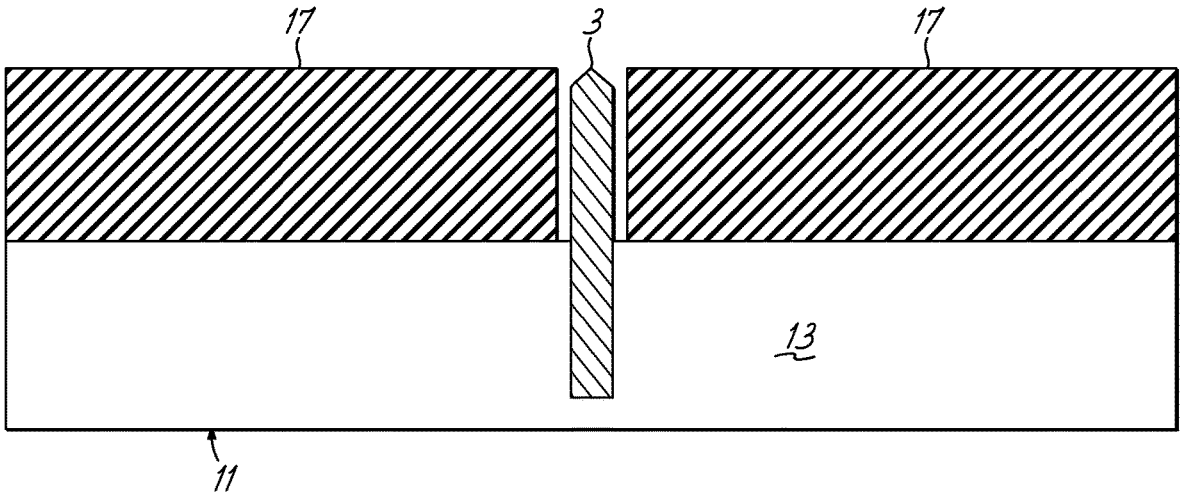
FIG. 6 PRIOR ART
FIG. 6 is a schematic cross-sectional view of prior art cutting rule and corresponding ejection foam as in FIG. 5.
Figure 7:
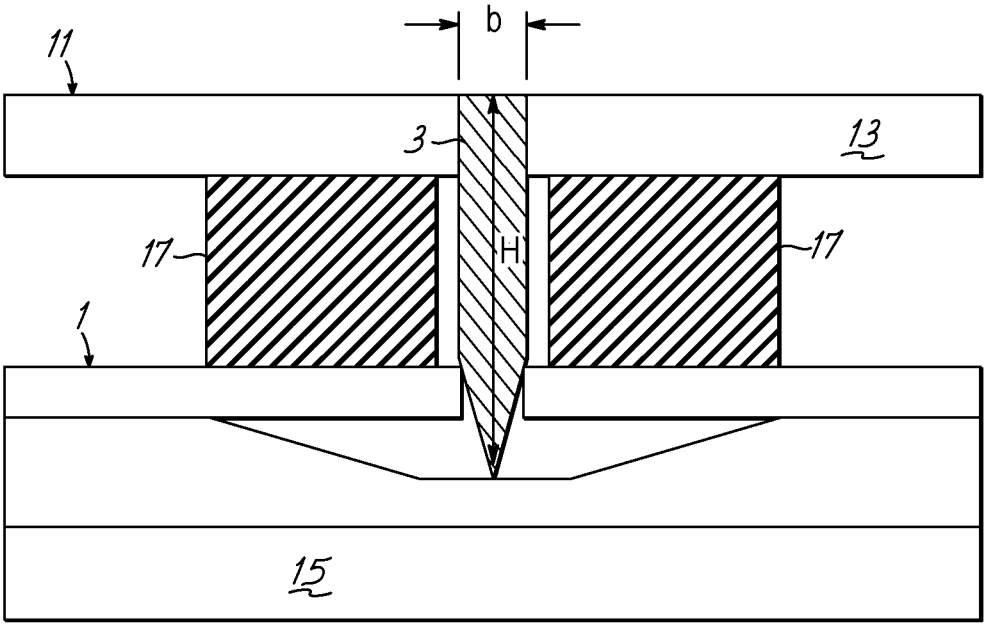
FIG. 7 PRIOR ART
FIG. 7 is a cross-sectional schematic view of a sheet of paperboard being cut with a cutting rule and a complementary make ready base.
Figure 8:
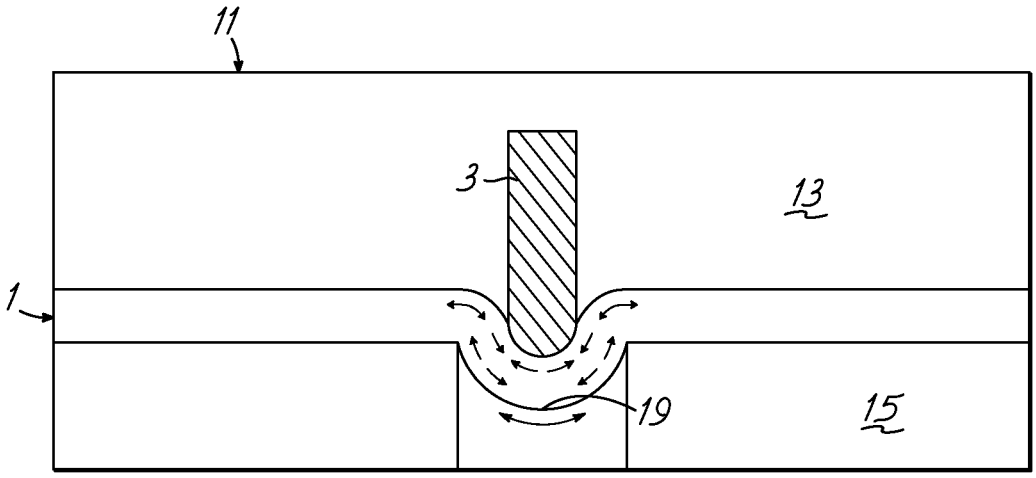
FIG.8 PRIOR ART
FIG. 8 is a schematic cross-sectional view of paperboard being creased by a prior art creasing rule on a make-ready base.

According to various embodiments of this invention, a cutting and/or creasing rule 10 is produced on a 3D printing machine 12 (FIG. 18) which may be mounted on a board 14 for use as a die for cutting and/or creasing a sheet of paperboard 1 or other material into a blank 5 for erecting a carton. While paperboard is commonly used to form the blank, the various aspects of this invention readily apply to materials other than paperboard which may be cut, creased and/or embossed. A wide variety of blanks 5 and resulting cartons may be produced with this invention, examples of which are shown in U.S. Pat. No. 9,499,297, which is incorporated by reference herein in its entirety. With the advent of additive manufacturing, i.e. 3D printing, it is now possible to eliminate traditional slotted die boards 13 (with generally rectangular steel cutting and creasing rules 3) and replace same with surface printed boards 14 with three-dimensional creasing and cutting rules 10.

One aspect of this invention is to "print" or manufacture the creasing and cutting rules 10 with various printable materials, e.g. HDPE, polycarbonates, etc. Another aspect of this invention is to achieve the strength characteristics or better of traditional steel creasing/cutting rules 3 by utilizing a 3D printed member instead of a traditional steel member. Since steel is much stronger than plastic, a dimensionally identical plastic structure will be weaker than the corresponding steel structure. To enhance the strength of three dimensionally printed rules in relation to traditional steel structures, the geometries, and more specifically the cross-sectional geometries in various embodiments, of the 3D printed creasing and cutting rule 10 is designed according to this invention both to withstand the downward and lateral forces exerted upon them by the die apparatus and to physically attach to the underlying die-board 14.

As noted above, the traditional steel creasing/cutting rule 3 is inserted into a slot (approximately ½ inch thick) which has been machined into the die-board 13 (corresponding to the desired shape of the carton to be cut/creased). Most of the prior art steel creasing rules 3 are therefore located beneath the surface of the die board 13. This provides lateral stability.

With a surface or 3D printed creasing/cutting rule 10 according to this invention, the lateral stability is provided for in the shape of the rule 10. The lateral stability of the 3D printed creasing/cutting rule 10 is therefore provided for with the geometry of the rule 10 itself and its attachment means to the die-board 14 or substrate.

The shape and geometries of the 3D printed rules 10 of various embodiments of this invention have a cross section shape which is wider at a proximal portion 16 and narrower at the distal portion 18, versus traditional creasing/cutting rules 3 which essentially have a constant width throughout with the minor rounded/sharpened tip at the very distal end. The distal portion 18 may have a first and a second exterior face 22, 24, respectively. Various exemplary configurations for the distal portion 18 and the faces 22, 24 are shown in FIGS. 9-17 while other configurations are within the scope of this invention.

Figure 9:
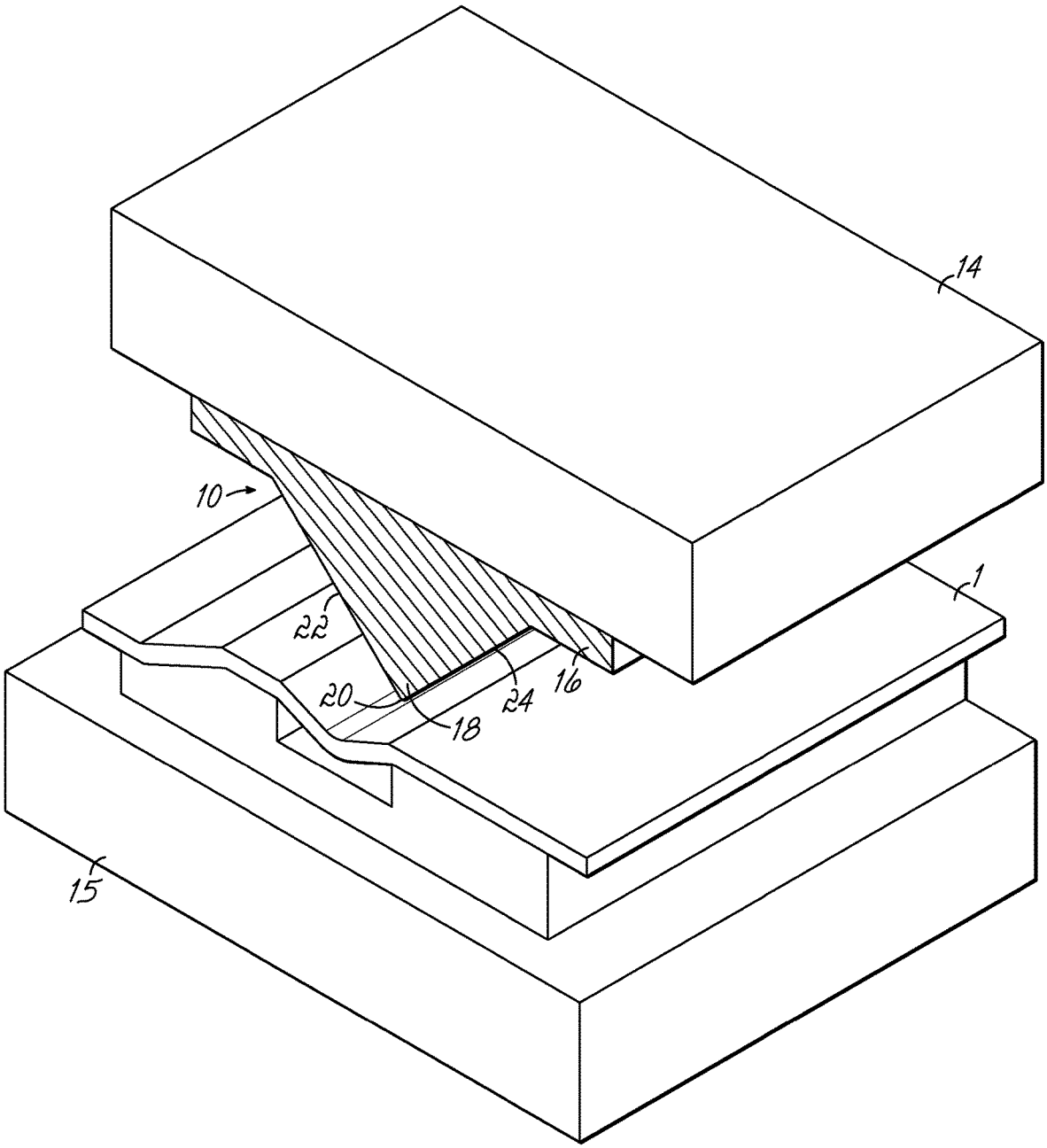
FIG. 9 is a perspective view of one embodiment of a creasing rule mounted on a board relative to a make-ready base with a sheet of paperboard therebetween according to this invention.
Figure 10:
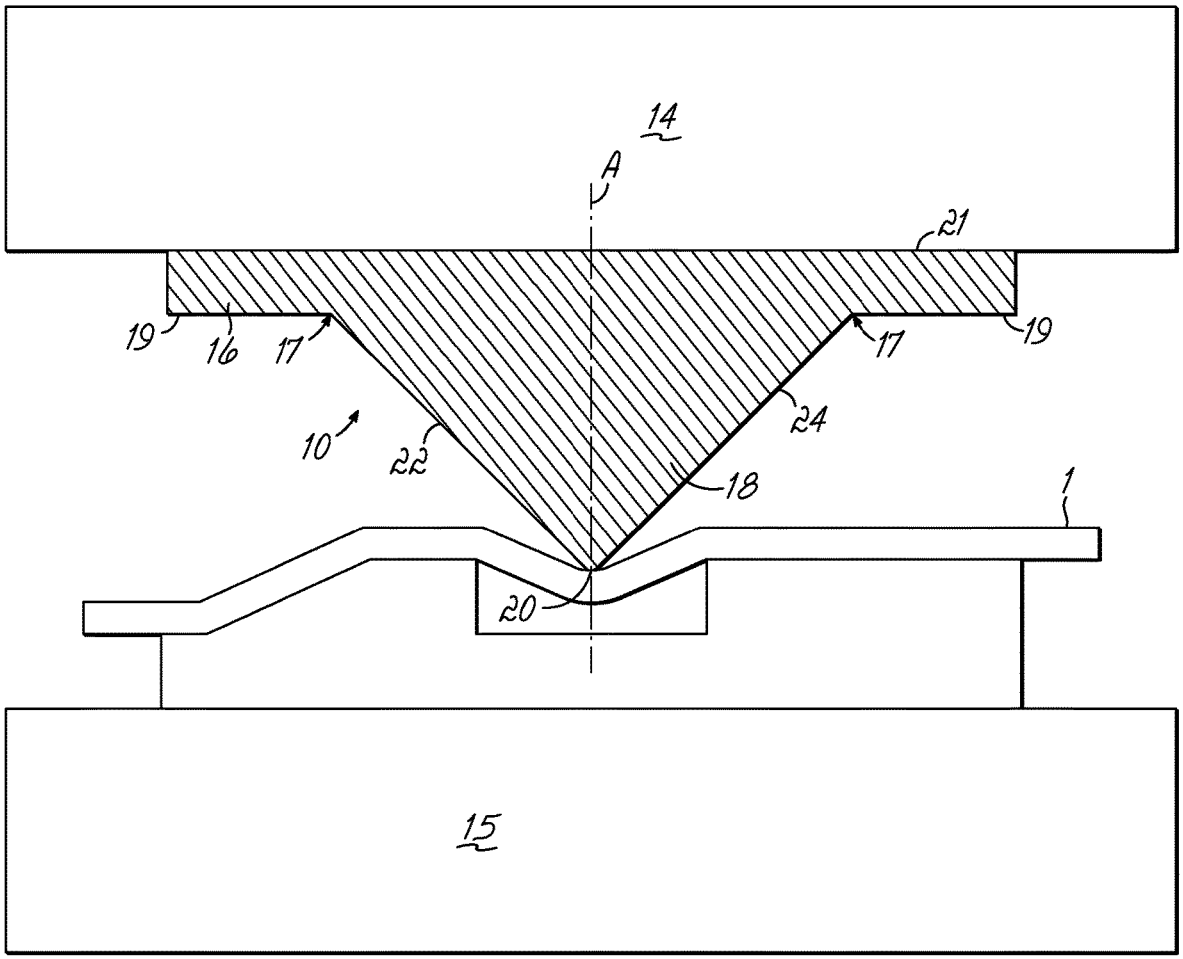
FIG. 10 is an end view of the arrangement of FIG. 9.
Figure 11:
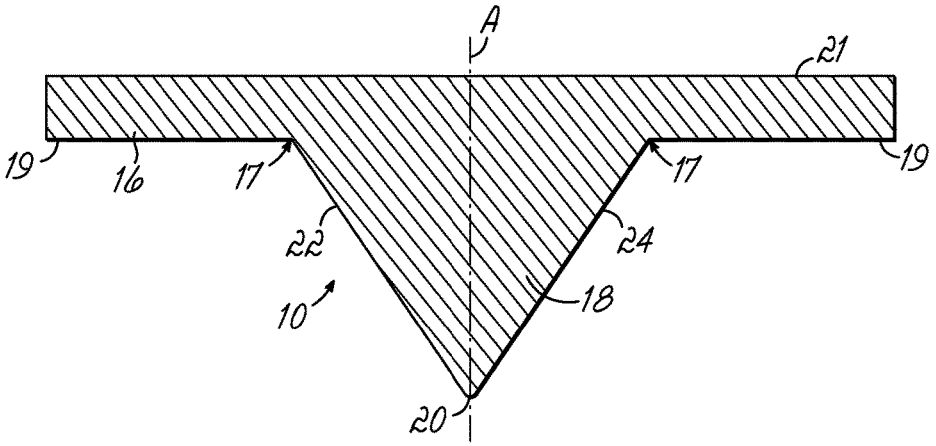
FIG. 11 is an end view of another embodiment of a creasing rule according to this invention.
Figure 12:
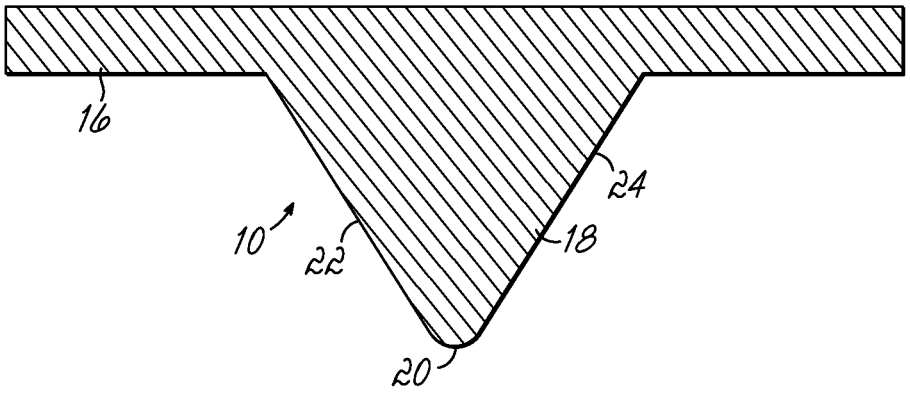
FIGS. 12-17 are similar views of further embodiments of creasing or cutting rules according to this invention.

Examples of 3D printed rules 10 according to various embodiments of this invention are shown in FIGS. 9-17 and other examples are disclosed in U.S. Design patent application Ser. No. 29/576,364, filed Sep. 2, 2016 and hereby incorporated by reference in its entirety. Those of ordinary skill in the art will appreciate that these are merely examples of 3D printed rules 10 according to this invention and other shapes, sizes, designs and geometries are within the scope of this invention. Various embodiments of 3D printed rules 10 according to this invention as shown in FIGS. 9-17 and other embodiments may include the proximal portion 16 of the rule 10 which is juxtaposed to the board 14 and the distal portion 18 of the rule 10 extends from the proximal portion 16 and toward the make-ready base 15 with the paperboard 1 positioned there between as shown in FIGS. 9-10. The distal portion 18 may include a tip 20 or other feature which contacts and engages the paperboard 1 to cut and/or crease the paperboard as required to form the paperboard blank 5.

Figure 13:
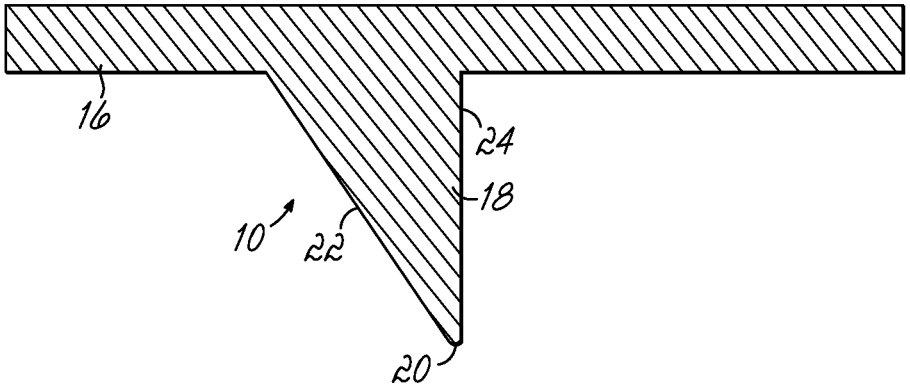
Figure 14:
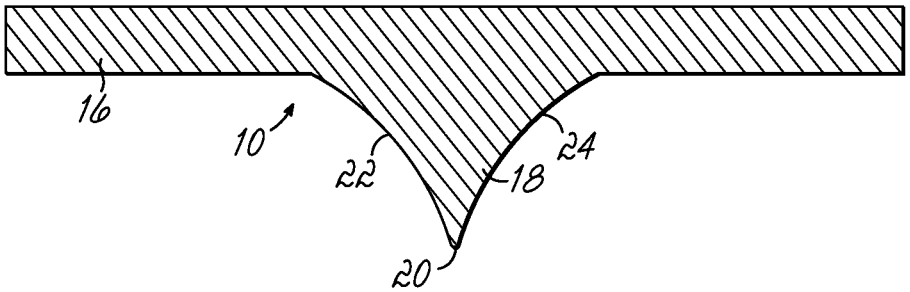
Figure 15:
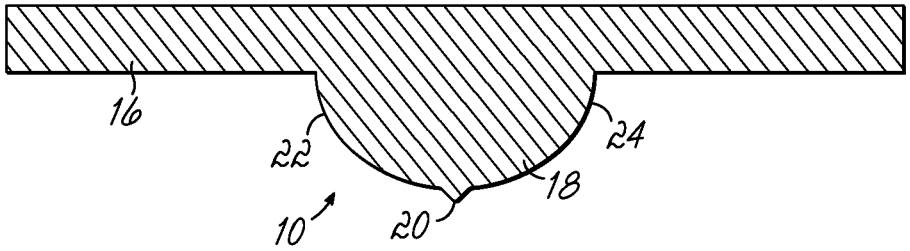
Figure 16:
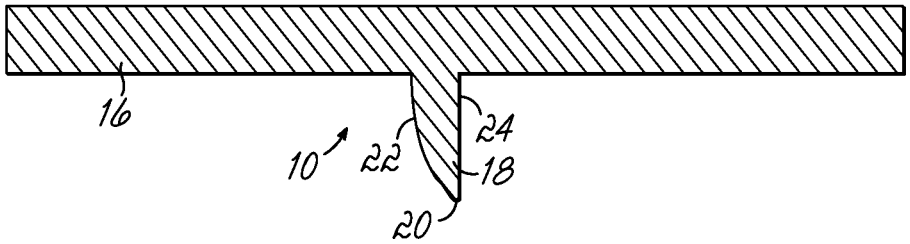
Figure 17:
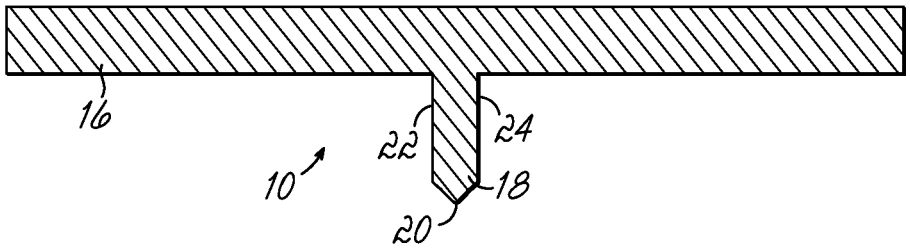

The distal portion 18 is narrower than the proximal portion 16 and may include a tapered or narrowing cross-sectional configuration compatible with the make-ready base 15. The distal portion 18 may be symmetric about an axis A extending generally perpendicular to the board 14 and through the tip 20 (FIGS. 9-12, 14-15 and 17) or the distal portion 18 may be asymmetric about such an axis (FIGS. 13, 16 and 17). In various embodiments of the rule 10 according to this invention, the width of the distal portion 18 decreases from a juncture 17 with the proximal portion 16 to the terminal tip 20 of the rule 10. The proximal portion 16 may have an outer face 19 which is opposite from and generally parallel to the die board 14 and an inner face 21 confronting the die board 14 and in contact with the die board 14 aligned with the axis A in one embodiment and along the entire inner face 21 in other embodiments. Those of ordinary skill in the art will appreciate that the tip 20 will engage the paperboard 1 during the cutting and/or creasing operation as well as portions of the distal portion 18 adjacent to the tip 20 may likewise act upon the paperboard 1. The wider shape of the proximal portion 16 adjacent to the distal portion 18 as well as the distal portion 18 itself provide enhanced strength and stability to the rule 10 to accommodate the lateral and other forces experienced by the rule 10 during the rocking motion of the die board assembly during cutting and creasing operations. The proximal portion 16 and distal portion 18 may be manufactured or printed as a unitary or monolithic structure or manufactured/printed separately and joined together to form the rule 10 according to various embodiments of this invention. In various embodiments, the rule 10 may be 3D printed directly onto the proximal portion 16 or base such that the rule 10 need not be printed on a skid or platform and then mounted onto the portion 16. Specifically, a polycarbonate rule 10 may be printed onto a polycarbonate base 16 according to one embodiment of this invention.

Figure 18:
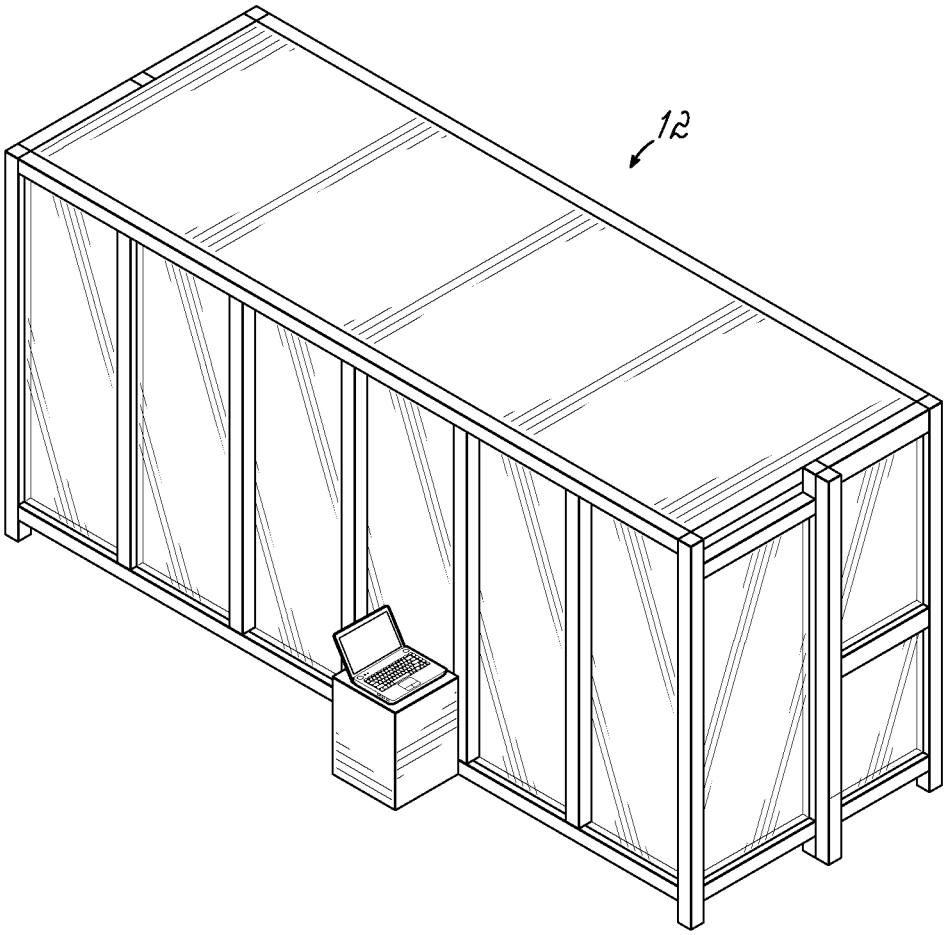
FIG. 18 is a perspective view of an exemplary industrial 3D printing machine.

The various geometries and designs of embodiments of the rule 10 according to this invention may be produced or printed on an industrial 3D printing machine 12, one example of which is shown in FIG. 18; however, the 3D printing machine 12 of FIG. 18 is merely exemplary and any of a wide variety of 3D printing machines 12 may be employed within the scope of this invention to produce the rules 10 according to this invention.

In addition to the geometries of the 3D printed rules 10 depicted and described herein, other aspects of this invention include methods for attaching the rule 10 to the die board 14.

One such method is that of printing a wider railroad track base as part of the proximal portion 16 or in conjunction therewith and affixing the rule 10 with adhesives and/or screws, tacks or other mechanical fasteners to counter the lateral forces created by the die cutting machine. The die machine operates in a rocking motion rather than a straight up/down motion which creates substantial lateral forces on the tooling. Alternatively, the proximal portion 16 of the rule 10 may include holes or apertures through which nails, screws or other fasteners may be inserted and subsequently embedded in the adjacent board 14 for securing the rule 10 to the board 14. Such techniques may also allow for removal and/or re-positioning of the rule 10 relative to the board 14.

The above methods may require the removal of 3D printed tooling from the platform of the 3D printer and re-registration on the die board 14. This can be accomplished by registering the rule 10 from a centerline on the die cutting machine.

Another method according to this invention involves first selecting the geometry of the creasing/cutting rule 10 based upon the orientation of the creasing/cutting rule 10 relative to the direction of the paper path on the die machine. For example, the cutting and creasing rule 10 located in the "front" of the die undergoes the greatest abuse due to the rocking movement of the die machine. A rule 10 with a wider proximal portion 16 provides better support to brace the rule 10, whereas, a rule 10 that runs parallel to the paper path may employ a narrower proximal portion 16 to save material, for example. As such, for a given paperboard blank 5 configuration, the rule 10 which is employed may have a different geometry for one region of the blank 5 than the rule 10 which is employed for other regions of the blank 5.

After selecting the dimensionally appropriate rule configuration, a polycarbonate die board may be placed directly beneath a 3D print head of a 3D printing machine 12. Next a polycarbonate or other suitable material is deposited on the polycarbonate die-board 14 and physically fused to the die-board 14 by heating that portion of the die-board 14 which is to be in contact with the rule 10 without heating the entire die-board 14 so as not to expand the die board 14 itself.

This results in a one-piece composite structure in perfect registration with no need to further register or attach the rule 10 to the die board 14. Instead, the actual die-board is removed from the 3D printer 12 and inserted directly into the die-chase of the die machine for cutting/creasing. 3D printers commonly print upon a heated surface. After printing the structure, it is removed from the 3D printer base. With various embodiments of this invention, the rule 10 is printed and fused directly on the die-board 14. Moreover, other aspects of this invention include 3D printing and/or fusing a piece of ejection material (with properties identical to the ejection rubber) directly on the die board without the need to either manually or mechanically cut/shape the rubber first.

Another aspect of this invention is a hybrid 3D print/analog die and counter. This embodiment starts with synthetic substrate shaped to the tooling that typically goes into the die-cutter (i.e. die board shape and counter plate shape). According to aspects of this invention, the 3D printer 12 may be designed in such a manner that the die boards 14 and counter plates 15 are actually the 3D printing base. Such a design of the 3D printer may be such that a heat source precedes the 3D printer head and warms only the portion of the surface that will come into contact with deposited material. Materials utilized for the rule 10 and board 14 may include those that when heated will permit fusing of deposited materials to the base.

Traditional die boards and counter plates are made of substances such as wood, stainless steel etc. and conventional 3D printed materials will not fuse/bond to them, at least not to the extent that they can withstand several tons of force.

Also, if a synthetic, such as a polycarbonate is heated in its entirety, it will expand and contract at a different rate than the 3D printed materials and the materials may dislodge from the base. Hence the laser-focused heating of the base.

Another embodiment uses the printed screw-hole design of creasing/cutting rule to further minimize the possibility of the rule coming loose under extreme pressure.

In various embodiments, it may be possible to 3D print the entire apparatus (die board and/or counter plate with appropriate rules/counters attached), and one would not have an issue with fusing the rule to the board/plate because it would already be in one piece. This may, however, add a lot of cost for deposited material, and take a great deal of time.

Other disadvantages of utilizing a solid piece are that there is no possibility for re-using the die board. With our invention, the rule 10 can be chiseled off and the surface reground/re-planed when the die becomes otherwise obsolete.

Another aspect of this invention includes the possibility that a die can be modified or repaired in the field using the laser-focused heat/3D print methodology. For example, if someone wanted to change a dispenser feature on a 12-pack without making an entirely new 3D printed die board/creasing/cutting rule, etc. he/she could do so with our technique but could not if they 3D printed the entire board, rule, counter, etc.

From the above disclosure of the general principles of this invention and the preceding detailed description of at least one embodiment, those skilled in the art will readily comprehend the various modifications to which this invention is susceptible. Therefore, I desire to be limited only by the scope of the following claims and equivalents thereof.

We claim:

1. A cutting/creasing rule for use on a die board for producing a carton blank from a sheet of blank material, the rule comprising:

a non-metal additive manufactured proximal portion;

a non-metal additive manufactured distal portion projecting from the proximal portion;

a non-metal additive manufactured tip on the distal portion which acts upon the sheet of blank material to form at least one of a cut and a crease in the sheet of blank material, wherein an inner face of the proximal portion confronting the die board and aligned with the tip is in contact with the die board to provide support to the tip; and an outer face on the proximal portion opposite from the die board and at a juncture with the distal portion, the outer face being parallel to the die board;

wherein the proximal portion is integral with the distal portion; and wherein the distal portion has a cross-sectional configuration which is wider than the tip and less wide than the proximal portion and a material of the proximal portion is the same as a material of the distal portion, a width of the cross-sectional configuration of the distal portion continuously increasing from the tip to the proximal portion.

2. The rule of claim 1 wherein the cross-sectional configuration of the distal portion is triangular.

3. The rule of claim 1 wherein the tip has a shape which is one of pointed and rounded.

4. The rule of claim 1 wherein the cross-sectional configuration of the distal portion is symmetric about a line extending perpendicularly from the proximal portion through the tip.

5. The rule of claim 1 wherein a cross-sectional configuration of the proximal portion is rectangular and a material of the tip is the same as a material of the distal portion.

6. The rule of claim 1 wherein the cross-sectional configuration of the distal portion is asymmetric about a line extending perpendicularly from the proximal portion through the tip.

7. The rule of claim 1 wherein the distal portion has a first exterior face and a second exterior face each of which extends from the proximal portion to the tip, wherein the first exterior face is at least one of the same configuration as the second exterior face, planar, convex, concave, and a different configuration than the second exterior face.

8. The rule of claim 1 wherein the tip is integral with the distal and proximal portions.

9. The rule of claim 1 wherein an entirety of the inner face of the proximal portion is in contact with the die board.

10. A die board for producing carton blanks, the die board comprising:

a board substrate; and a cutting/creasing rule, the rule comprising:

(a) a non-metal additive manufactured proximal portion;

(b) a non-metal additive manufactured distal portion projecting from the proximal portion;

(c) a non-metal additive manufactured tip on the distal portion which acts upon a sheet of blank material to form at least one of a cut and a crease in the sheet of blank material, wherein an inner face of the proximal portion confronting the board substrate and aligned with the tip is in contact with the board substrate to provide support to the tip; and (d) an outer face on the proximal portion opposite from the board substrate and at a juncture with the distal portion, the outer face being parallel to the board substrate;

wherein the proximal portion is integral with the distal portion; and wherein the distal portion has a cross-sectional configuration which is wider than the tip and less wide than the proximal portion and a material of the proximal portion is the same as a material of the distal portion, a width of the cross-sectional configuration of the distal portion continuously increasing from the tip to the proximal portion.

11. The die board of claim 10 wherein the cross-sectional configuration of the distal portion is triangular.

12. The die board of claim 10 wherein the tip has a shape which is one of pointed and rounded.

13. The die board of claim 10 wherein the cross-sectional configuration of the distal portion is symmetric about a line extending perpendicularly from the proximal portion through the tip.

14. The die board of claim 10 wherein a cross-sectional configuration of the proximal portion is rectangular and a material of the tip is the same as a material of the distal portion.

15. The die board of claim 10 wherein the cross-sectional configuration of the distal portion is asymmetric about a line extending perpendicularly from the proximal portion through the tip.

16. The die board of claim 10 wherein the distal portion has a first exterior face and a second exterior face each of which extends from the proximal portion to the tip, wherein the first exterior face is at least one of the same configuration as the second exterior face, planar, convex, concave, and a different configuration than the second exterior face.

17. The die board of claim 10 wherein the tip is integral with the distal and proximal portions.

18. The die board of claim 10 wherein an entirety of the inner face of the proximal portion is in contact with the board substrate.

19. A method of producing a non-metal cutting/creasing rule for use on a die board for producing carton blanks, the method comprising the steps of:

positioning a proximal portion of the rule; and additive manufacturing a distal portion and a tip of the rule on the proximal portion of the rule, wherein the distal portion has a cross-sectional configuration which is wider than the tip and less wide than the proximal portion, a width of the cross-sectional configuration of the distal portion continuously increasing from the tip to the proximal portion, wherein an inner face of the proximal portion confronting the die board and aligned with the tip is in contact with the die board to provide support to the tip;

wherein an outer face of the proximal portion opposite from the die board and at a juncture with the distal portion is parallel to the die board;

wherein the proximal portion is integral with the distal portion;

wherein a material of the proximal portion is the same as a material of the distal portion; and wherein the distal portion and the tip of the rule are produced without benefit of any subtractive manufacturing techniques.

20. The method of claim 19 wherein the cross-sectional configuration of the distal portion is triangular.

21. The method of claim 19 wherein the tip has a shape which is one of pointed and rounded.

22. The method of claim 19 wherein the cross-sectional configuration of the distal portion is symmetric about a line extending perpendicularly from the proximal portion through the tip.

23. The method of claim 19 wherein a cross-sectional configuration of the proximal portion is rectangular and a material of the tip is the same as a material of the distal portion.

24. The method of claim 19 further comprising:

additive manufacturing the tip, the distal portion and the proximal portion to be integral with one another.

25. The method of claim 19 further comprising:

contacting an entirety of the inner face of the proximal portion with the die board.

* * * * *